US007743891B2

(12) United States Patent
Tyni et al.

(10) Patent No.: US 7,743,891 B2
(45) Date of Patent: Jun. 29, 2010

(54) ELEVATOR SYSTEM

(75) Inventors: Tapio Tyni, Hyvinkää (FI); Pekka Perälä, Kerava (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/464,963

(22) Filed: May 13, 2009

(65) Prior Publication Data

US 2009/0218177 A1 Sep. 3, 2009

Related U.S. Application Data

(63) Continuation of application No. PCT/FI2007/000285, filed on Dec. 5, 2007.

(30) Foreign Application Priority Data

Dec. 8, 2006 (FI) ..... 20061089

(51) Int. Cl.
*B66B 1/34* (2006.01)

(52) U.S. Cl. ..... 187/393

(58) Field of Classification Search ..... 187/250, 187/277, 283, 286, 291, 292, 302, 303, 391–393
See application file for complete search history.

(56) References Cited

U.S. PATENT DOCUMENTS

| | | | | | |
|---|---|---|---|---|---|
| 3,065,823 | A * | 11/1962 | Burgy | 187/392 |
| 5,258,587 | A * | 11/1993 | Kezer et al. | 187/392 |
| 5,435,416 | A * | 7/1995 | Siikonen et al. | 187/392 |
| 5,485,347 | A * | 1/1996 | Miura | 702/128 |
| 7,376,533 | B2 * | 5/2008 | Fujiwara | 702/160 |
| 2003/0074986 | A1 | 4/2003 | Yamakawa et al. | |

FOREIGN PATENT DOCUMENTS

| | | | |
|---|---|---|---|
| EP | 0 528 188 | A1 | 2/1993 |
| EP | 0 547 900 | A2 | 6/1993 |
| JP | 7-215611 | A | 8/1995 |
| WO | WO-2005/102895 | A1 | 11/2005 |

* cited by examiner

*Primary Examiner*—Jonathan Salata
(74) *Attorney, Agent, or Firm*—Birch, Stewart, Kolasch & Birch, LLP

(57) ABSTRACT

The present invention discloses a method, a device, a computer program and a system for detecting the arrival in the elevator car/departure from the elevator car of elevator passengers. In the method the vertical acceleration values of the elevator car are received from the acceleration sensor and the passengers arriving in the elevator car and/or leaving the elevator car are detected on the basis of the vertical acceleration measurements of the acceleration sensor.

20 Claims, 9 Drawing Sheets

ELEVATOR SYSTEM

Figure 1:
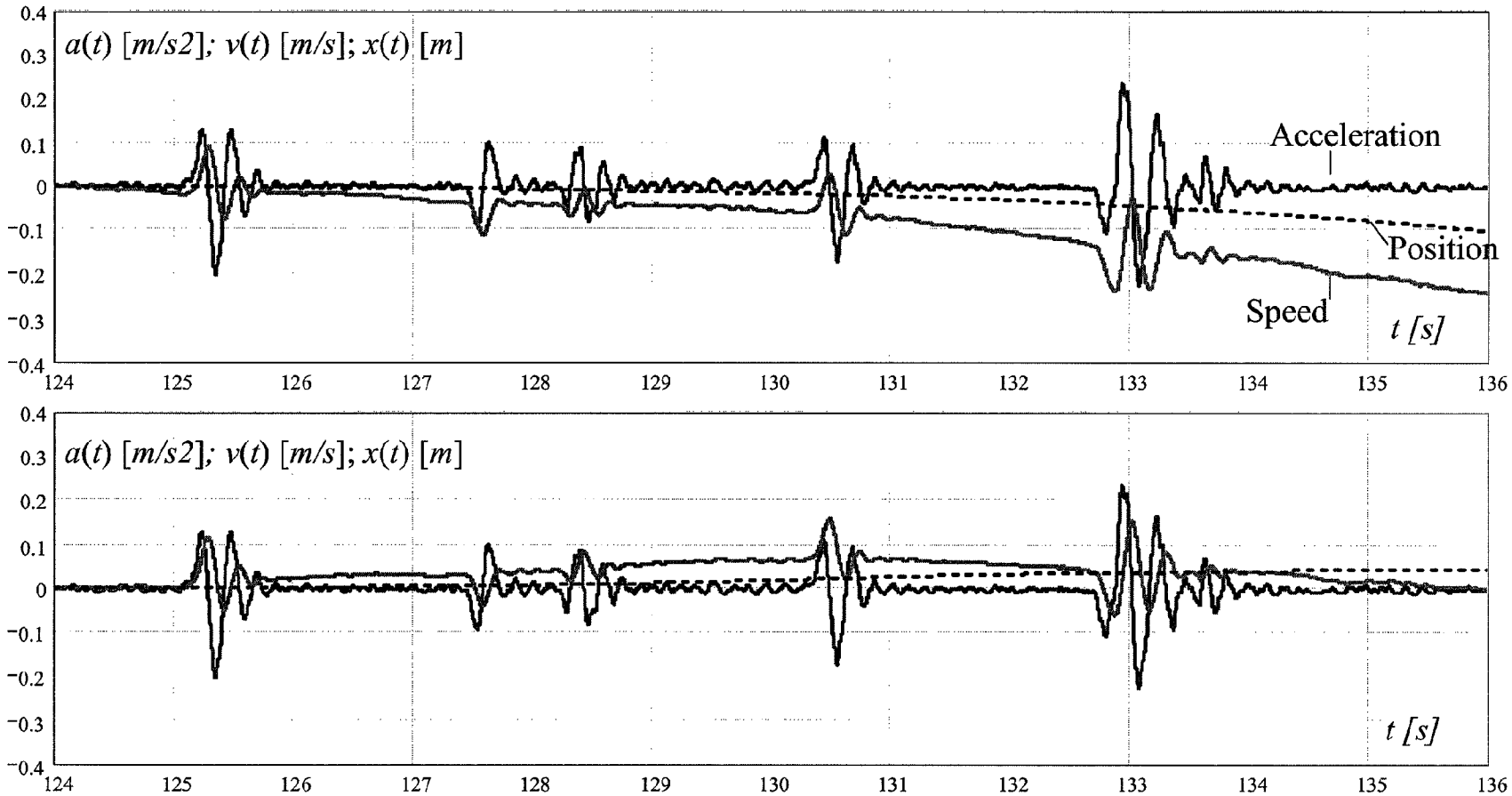
Fig. 1 (Prior art)

This application is a Continuation of copending PCT International Application No. PCT/FI2007/000285 flied on Dec. 5, 2007, which designated the United States, and on which priority is claimed under 35 U.S.C. §120. This application also claims priority under 35 U.S.C. §119(a) on Patent Application No(s). 20061089 filled in Finland on Dec. 8, 2006, the entire contents of each of the above documents is hereby incorporated by reference into the present application.

FIELD OF THE INVENTION

The present invention relates to elevator systems. More particularly the present invention relates to a method, a device, a computer program and a system for detecting passengers stepping into an elevator car and exiting from it.

BACKGROUND OF THE INVENTION

It is essential from the standpoint of the efficient use of elevator systems in buildings to know the passenger flows inside the building and how many passengers are in the elevator cars in different operating situations. More particularly information about passengers arriving in the elevator cars and exiting from them on each landing gives detailed information about the passenger flows of the buildings, from which it is possible to compile, among other things, statistics for evaluating and for improving the efficiency of the use of the elevator systems. By means of statistics it is also possible to estimate the service need of elevator systems and to prepare forecasts of the numbers of passengers to be served. Up-to-date information about the numbers of passengers in elevator cars can, for its part, be utilized in different operating situations, such as e.g. in interruptions to the operation of the elevator. As a result of the advantages to be achieved, the need for measuring passenger flows often becomes a issue to address when modernizing old elevator systems and/or when installing a condition monitoring system in an elevator system, in connection with which it is desired to integrate the monitoring of passenger traffic.

The movement of elevator passengers into the elevator car and out of the elevator car is in prior art determined by using door photoelectric cells for detecting the movement of people or by measuring the load of the elevator car by means of a so-called car load weighing device e.g. during a stop of the elevator. The separating capability of a photoelectric cell is however limited in peak-traffic situations, especially if there is simultaneous traffic in both directions at the doors. When using load information, the load of the elevator at the time of stopping, at the time of starting, and the smallest load during the time between these, has been measured. From these results the number of incoming and outgoing passengers has been calculated utilizing the average weight of a passenger. In the method it is assumed that all the exiting passengers leave the car before the incoming passengers step into the car, which does not correspond to the real situation. The divergences of the weight of actual people and the weight of a normalized elevator passenger also cause an inaccuracy.

One prior-art solution is disclosed in patent application EP0528188, in which the arrival in the car and departure of passengers is detected from changes occurring in the signal of the car load weighing device. The method improves the method presented above that is based on the signal of the load weighing device but is however imprecise owing to the inaccuracy of the signal of the load weighing device and the limited frequency response of the car load weighing device.

More particularly the solution is difficult to implement when modernizing elevators because connecting to the load-weighing signal can be awkward or the elevator car totally lacks a car load weighing device.

An acceleration sensor can be used in an elevator system for many kinds of measurements. For example, the acceleration of the elevator car can be monitored with an acceleration sensor. From the measurements given by from the sensor it is possible to calculate, in addition to acceleration, e.g. the position of the elevator in the elevator shaft and the stopping accuracy of the elevator floor by floor. Overall a very comprehensive view of the operation of the whole elevator can be formed from the measurement results of the acceleration sensor. One possible embodiment of an acceleration sensor in connection with elevator systems is to detect the arrival/departure of passengers into the elevator car/out of the elevator car by means of an acceleration sensor fixed to the elevator car.

Acceleration measurement in itself is not usually adequate as a basis for signal processing, but instead generally it is necessary to integrate in order to ascertain more accurate results. In this case so-called bias problems (deviations) caused by installation errors of the sensor are inevitably encountered. Bias problems are caused by, among other things, the acceleration sensor never being in practice fully perpendicular with respect to the direction of movement to be measured. In addition, if the acceleration sensor is installed on the roof of the elevator, it inclines dynamically with the car as the loading of the car changes. FIG. 1 illustrates one such situation.

In FIG. 1 the elevator is standing at a floor with passengers exiting and arriving in the car. The upper curve in FIG. 1 presents a situation in which the acceleration as such is integrated into speed v(t) and speed, for its part, into position x(t).

$$v(t) = v_0 + \int_{T_0}^{T} a(t)\,dt \approx \sum_{k=1}^{N} a(k)\Delta t \tag{1}$$

$$x(t) = x_0 + \int_{T_0}^{T} v(t)\,dt \approx \sum_{k=1}^{N} v(k)\Delta t$$

where $v_0=0$, $x_0=0$, $T_0$=the moment when the door is open and passengers are able to move and T is the moment in time when the closing stage of the door starts, $\Delta t$ is the discrete interval (sampling interval) and N is the number of samples.

As is seen from FIG. 1, the error caused by the inclination of the car accumulates in the integration, in which case speed and position "escape" uncontrollably. It is possible to attempt to improve the situation with the fact that the speed of the car at the start and at the end of the loading cycle is zero:

$$\hat{v}(t) = \int_{T_0}^{T} a(t)\,dt \approx \sum_{k=1}^{N} a(k)\Delta t \tag{2}$$

$$\bar{a}_b = \frac{\hat{v}(T) - 0}{T - T_0}$$

$$v(t) = \int_{T_0}^{T} (a(t) - \bar{a}_b)\,dt \approx \sum_{k=1}^{N} (a(k) - \bar{a}_b)\Delta t$$

-continued $$x(t) = \int_{T_0}^{T} v(t)\,dt \approx \sum_{k=1}^{N} v(k)\Delta t$$

The above integrates at first the measured acceleration for calculating the speed $\hat{v}(t)$, the average error $\bar{a}_b$ for acceleration is calculated from the final error of speed (the end condition of integration is that the speed of the car must be zero). With this term the speed v(t) and finally the position x(t) are integrated again from the corrected acceleration. From the lower curve of FIG. 1 it is seen that the situation improves slightly, but not however sufficiently. The deviations in the position of the car produced by the passengers are generally of the order of magnitude of hundreds of micrometers and at their maximum of some millimeters. In the lower curve of FIG. 1 the calculated deviation of the car is approx. 50 mm. On the basis of FIG. 1 it is seen that the deviations in the position of the car produced by the passengers are lost in the errors caused by inclination of the car and reliable detection of the passengers from a signal thus corrected is very problematic.

SUMMARY OF THE INVENTION

The purpose of the present invention is to disclose a new method, device, computer program and system for detecting passengers stepping into an elevator car and exiting from it. The term "detect" means in this context that in the solution according to the invention the arrival in the elevator car/departure from the elevator car of an elevator passenger is detected (observed).

The method, the computer program, the device and the system according to the invention are characterized by what is disclosed in the characterization part of claims 1, 7, 9 and 14. Other embodiments of the invention are characterized by what is disclosed in the other claims. Some inventive embodiments are also presented in the drawings in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the scope of the basic inventive concept in conjunction with other embodiments.

In accordance with the first aspect of the invention, a method for detecting elevator passengers is presented. In the method the vertical acceleration values of the elevator car are received from the acceleration sensor and the passengers arriving in the elevator car and/or leaving the elevator car are detected on the basis of the vertical acceleration measurements of the acceleration sensor.

In one embodiment of the invention the calculated speed of the elevator car is calculated from the vertical acceleration measurements of the acceleration sensor, the calculated speed is preprocessed by rendering the speed of the elevator car as zero elsewhere except in a situation of loading passengers or in a situation of unloading passengers, and the passengers arriving in the elevator car and/or leaving the elevator car are detected from the preprocessed speed on the basis of the calculated position of the elevator car. The term "rendering" means in this context that the speed is set at zero elsewhere except in a loading situation or an unloading situation, after which elimination of the offset (bias) is performed for each loading situation and unloading situation. In one embodiment a movement indicator is used in the preprocessing, which detects a situation of loading passengers or a situation of unloading passengers from the fluctuation of movement of the car.

In one embodiment of the invention the passengers arriving in the elevator car and/or leaving the elevator car are detected from the preprocessed speed on the basis of the calculated position of the elevator car with the correlation method.

In one embodiment of the invention the passenger last arriving in the elevator car or leaving from it is detected for measuring the photoelectric cell delay of the elevator.

In accordance with the second aspect of the invention, a computer program is presented. The computer program is arranged to perform the phases of the method presented in the method claims 1-5. In one embodiment of the invention the computer program is stored on a data processing appliance on a readable storage medium.

In accordance with the third aspect of the invention, a device for detecting elevator passengers is presented. The device is arranged to receive the vertical acceleration values of the elevator car from the acceleration sensor and to detect the passengers arriving in the elevator car and/or leaving the elevator car on the basis of the vertical acceleration measurements of the acceleration sensor.

In one embodiment of the invention the device is arranged to calculate the calculated speed of the elevator car from the vertical acceleration measurements of the acceleration sensor, to preprocess the calculated speed by rendering the speed of the elevator car as zero elsewhere except in a situation of loading passengers or a situation of unloading passengers, and to detect the passengers arriving in the elevator car and/or leaving the elevator car from the preprocessed speed on the basis of the calculated position of the elevator car. In one embodiment the device is arranged to use a movement indicator in the preprocessing, which detects a passenger loading situation or a passenger unloading situation from the fluctuation of movement of the car. In one embodiment of the invention the passengers arriving in the elevator car and/or leaving the elevator car are detected from the preprocessed speed on the basis of the calculated position of the elevator car with the correlation method.

In one embodiment of the invention the device is arranged to detect the passenger last arriving in the elevator car or leaving from it and to measure the photoelectric cell delay of the elevator on the basis of the detected last passenger.

In one embodiment of the invention the device comprises an interface for connecting the device to separate systems, to which the device is arranged to convey information about the passengers.

In accordance with the fourth aspect of the invention, a system for detecting elevator passengers is presented. The system comprises an elevator car and an acceleration sensor that measures its acceleration. The system further comprises analyzer means for receiving the vertical acceleration values of the elevator car from the acceleration sensor and for detecting the passengers arriving in the elevator car and/or leaving the elevator car on the basis of the vertical acceleration measurements of the acceleration sensor.

In one embodiment of the invention the analyzer means are further arranged to calculate the calculated speed of the elevator car from the vertical acceleration measurements of the acceleration sensor, to preprocess the calculated speed by rendering the speed of the elevator car as zero elsewhere except in a passenger loading situation or a passenger unloading situation, and to detect the passengers arriving in the elevator car and/or leaving the elevator car from the preprocessed speed on the basis of the calculated position of the elevator car. In one embodiment the analyzer means are further arranged to use a movement indicator in the preprocessing, which detects a passenger loading situation or a passenger unloading situation from the fluctuation of movement of the elevator car. In one embodiment of the invention the analyzer means are arranged to detect the passengers arriving in the elevator car and/or leaving the elevator car are detected from the preprocessed speed on the basis of the calculated position of the elevator car with the correlation method.

In one embodiment of the invention the analyzer means are arranged to detect the passenger last arriving in the elevator car or leaving from it, and the system further comprises determination means for measuring the photoelectric cell delay of the elevator.

As a result of the present invention by monitoring vertical acceleration it is possible to detect a passenger leaving the elevator car and arriving in the elevator car. Additionally, the information produced by the invention can be used in a condition monitoring system of the elevator and in monitoring as well as in forecasting the passenger traffic of the elevator. The solution according to the invention can be easily installed in both new elevators and in elevators already in use.

LIST OF FIGURES

Figure 2A:
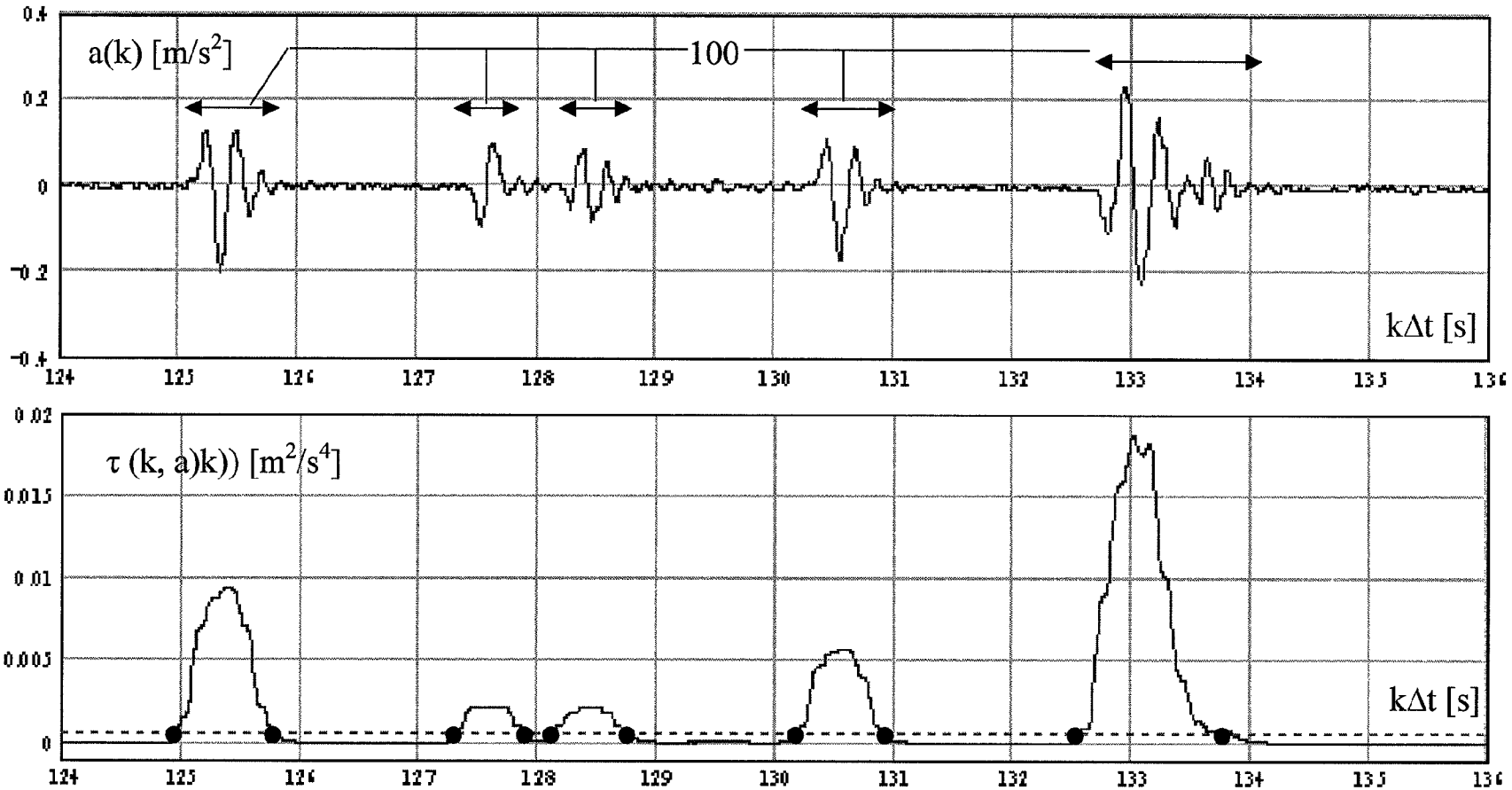
Figure 2B:
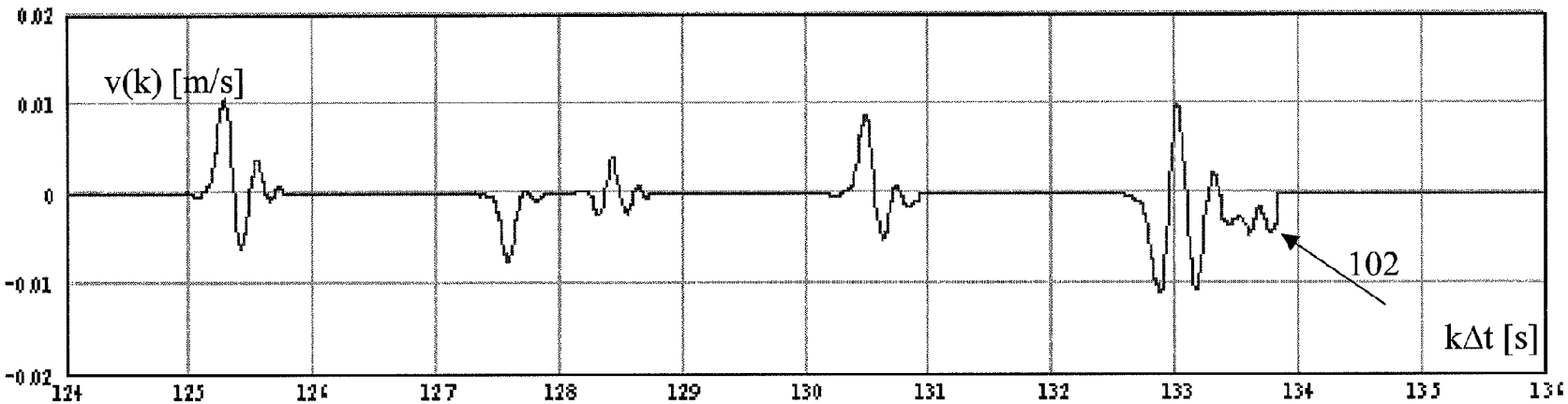
Figure 3:
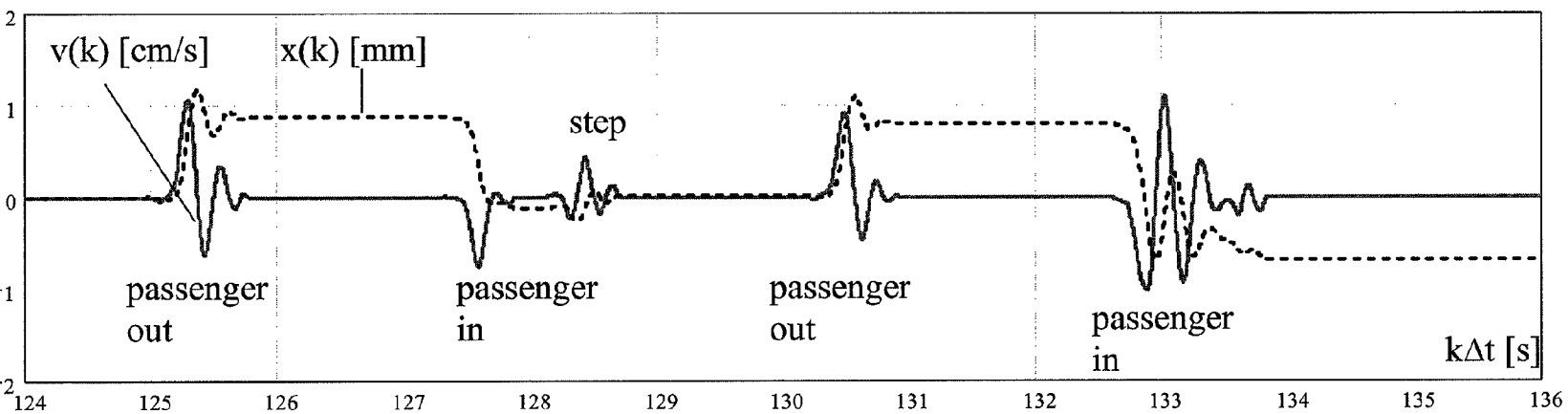
Figure 4:
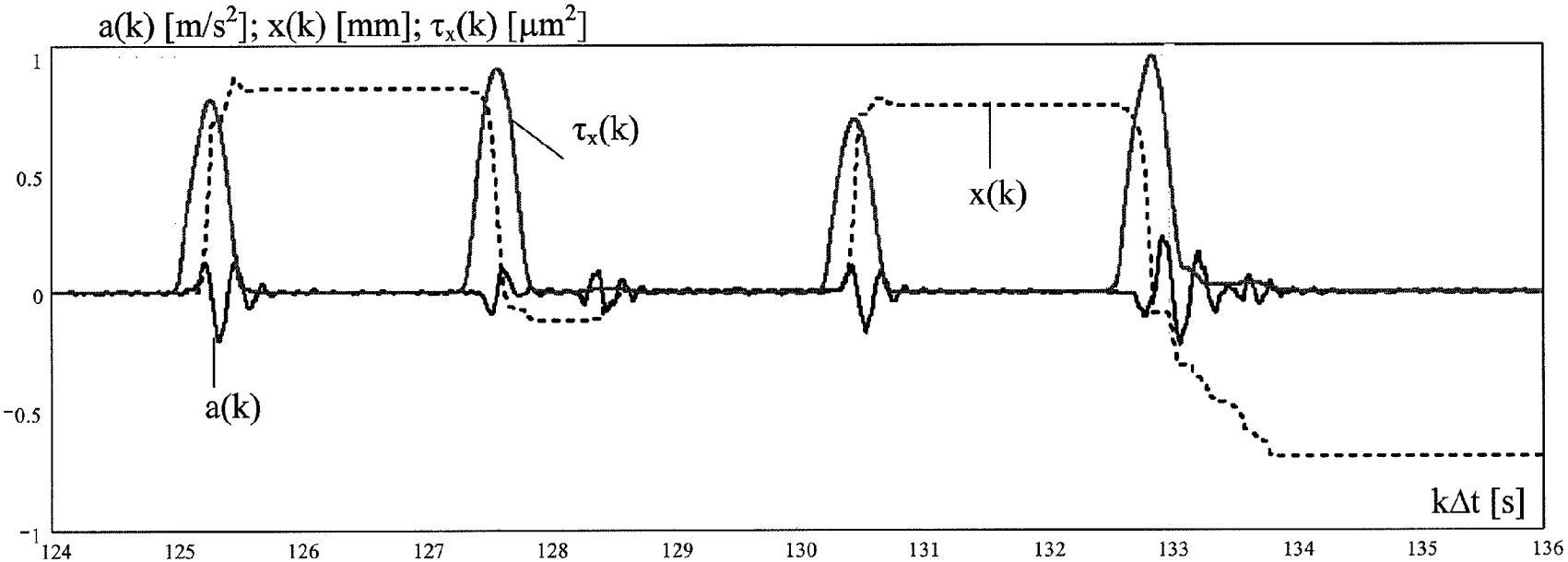
Figure 5A:
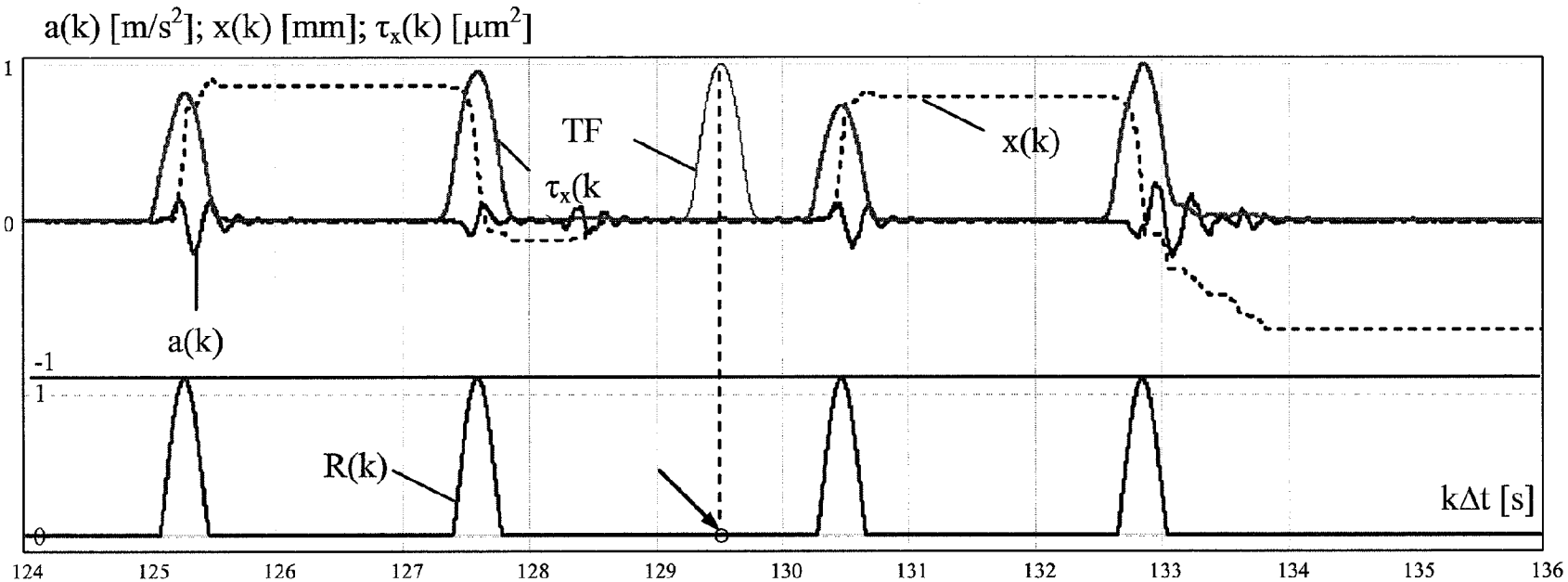
Figure 5B:
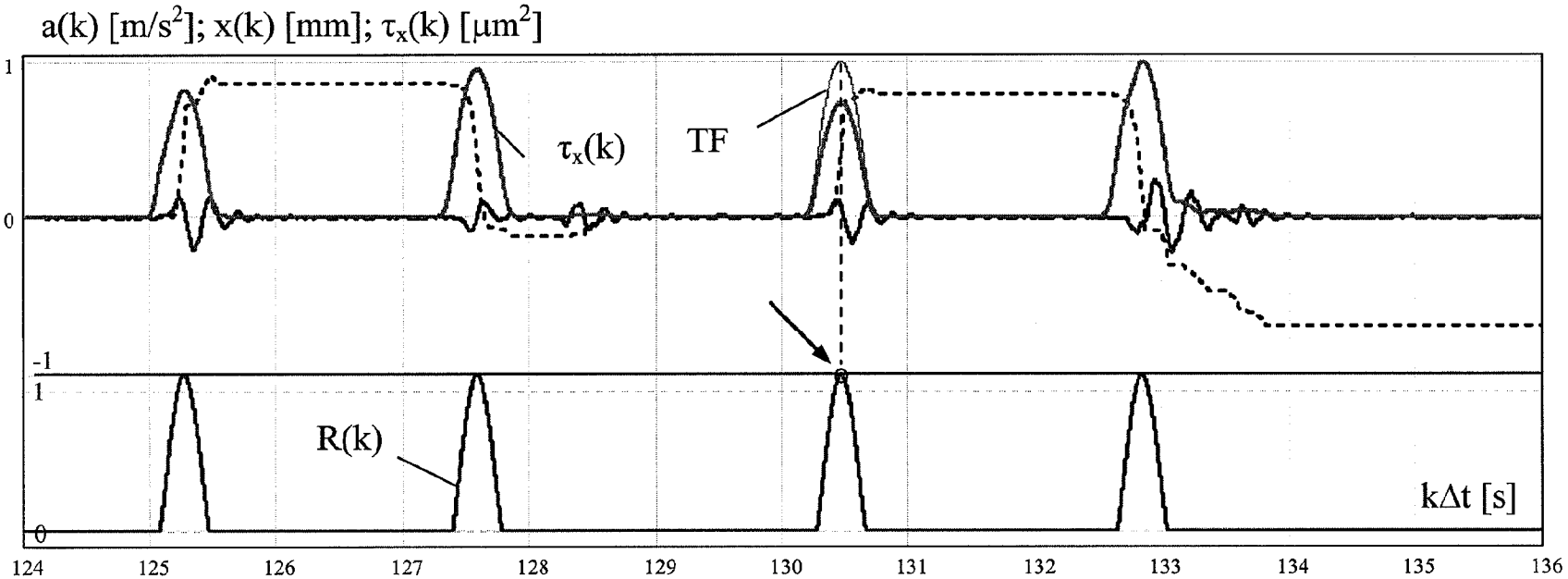
Figure 6:
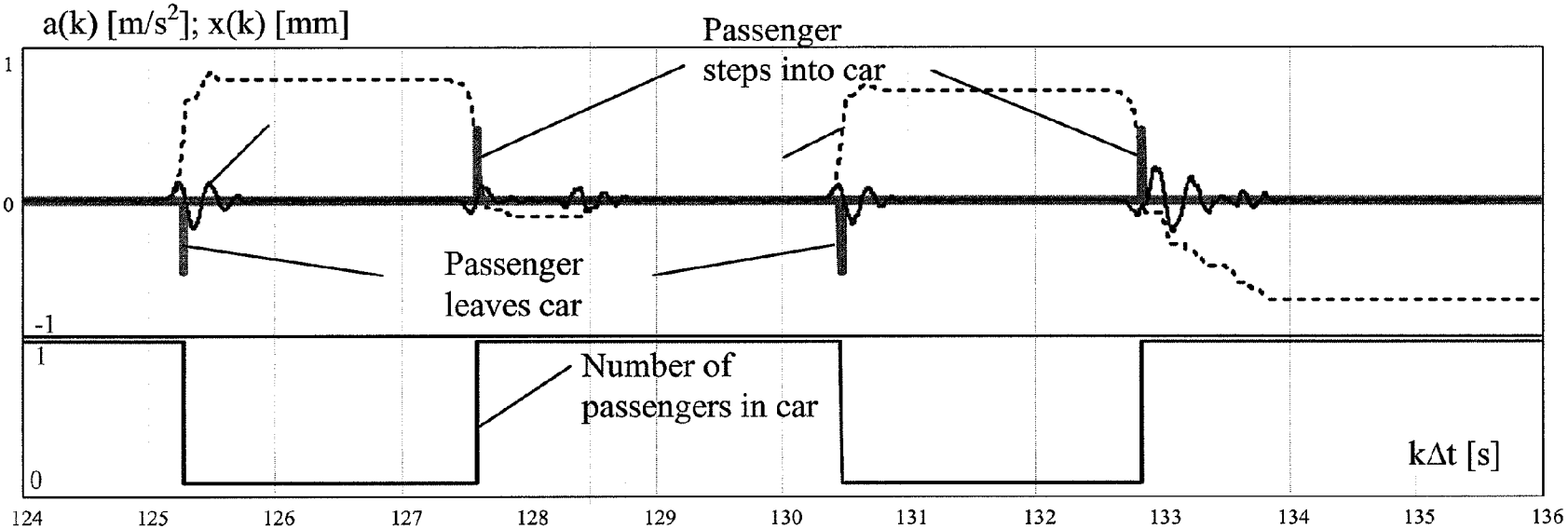
Figure 7A:
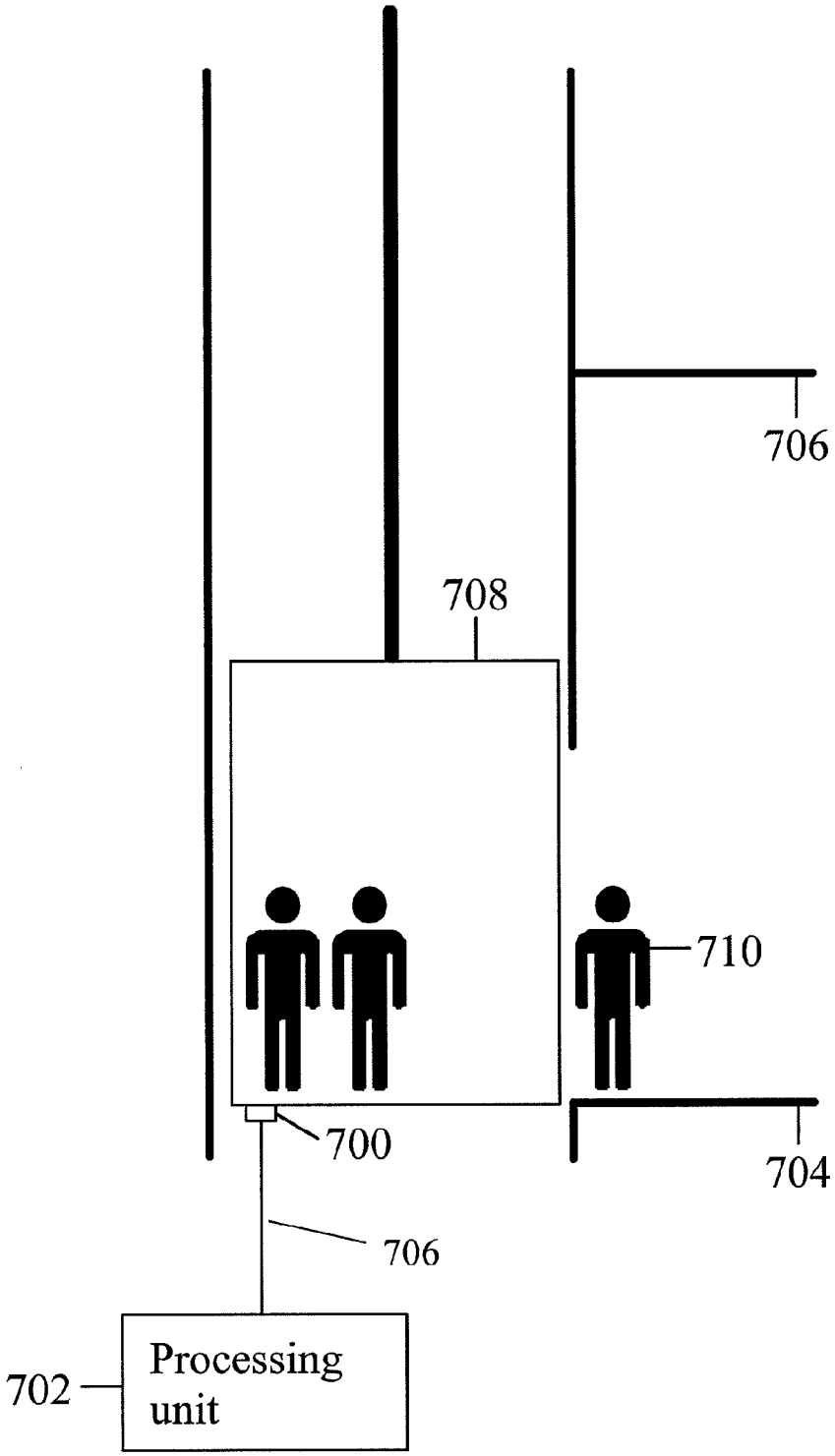
Figure 7B:
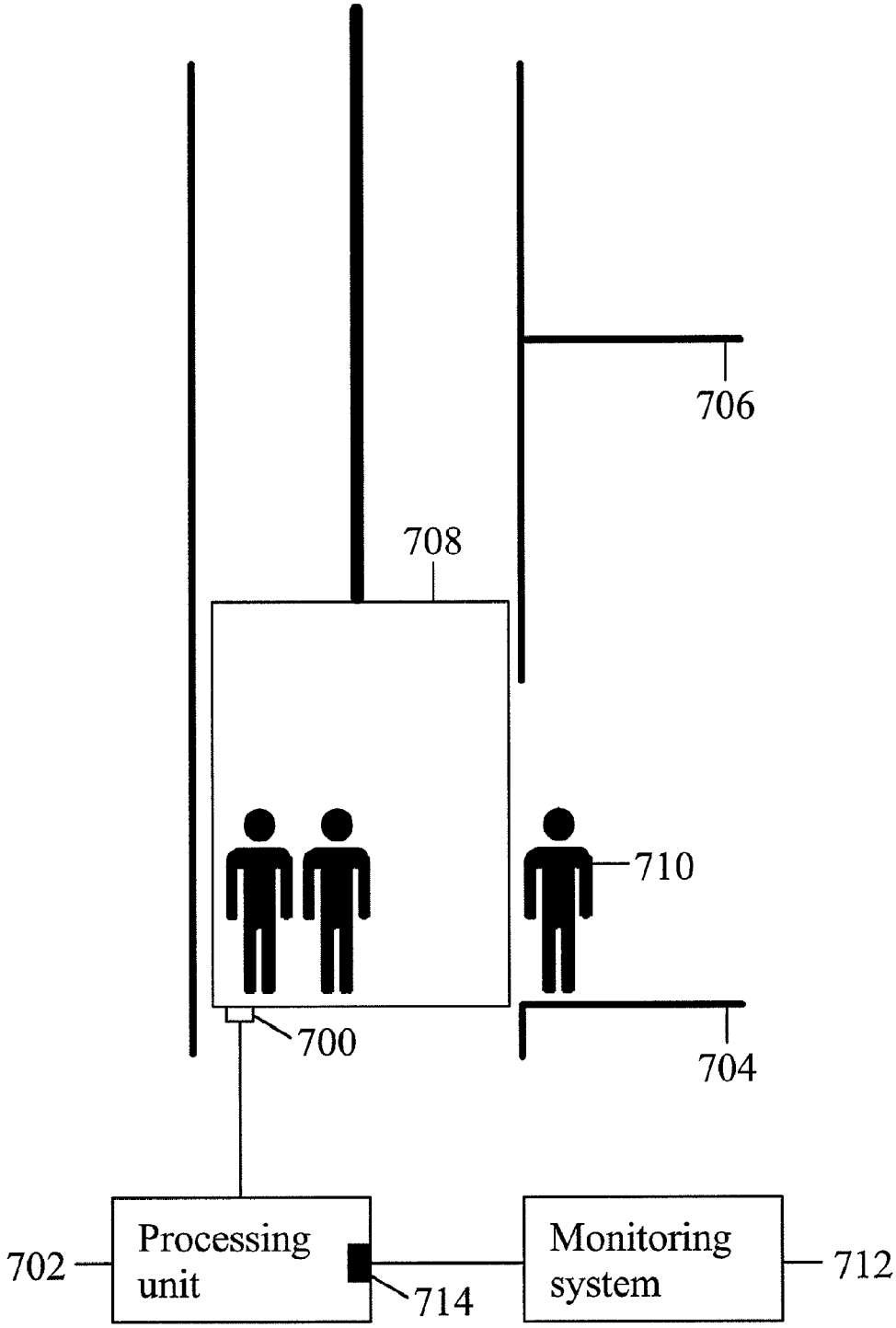

In the following, the invention will be described in detail by the aid of a few examples of its embodiments, wherein:

FIG. 1 presents a method for compensating the errors of the acceleration signal of the elevator car;

FIGS. 2*a* and 2*b* present the preprocessing of the acceleration signal of the elevator car with segmented bias compensation;

FIG. 3 presents the speed and position of the elevator car calculated with segmented bias compensation;

FIGS. 4, 5*a*, 5*b*, 6 present a method according to the invention for detecting passengers with the correlation method; and FIGS. 7*a* and 7*b* present a system according to the invention as a block diagram.

DETAILED DESCRIPTION OF THE INVENTION

FIGS. 2*a* and 2*b* present an embodiment of the invention in which the vertical acceleration signal given by the acceleration sensor is processed and the passengers are detected from the processed acceleration signal.

In the embodiment of the invention presented in FIGS. 2*a* and 2*b* the acceleration signal is preprocessed with segmented bias compensation.

In the embodiment of FIGS. 2*a* and 2*b* the speed is set by default to be zero in the inspection period when the elevator is standing at a floor. This is done everywhere else except in those periods of time when a passenger leaves, arrives or moves in the car. The inspection period is e.g. the time from the moment when the door of the elevator car has fully opened to the moment when the closing phase of the door starts, but it can also be defined as another period of time suited to the purpose. The basic assumption is that the car is in practice stationary other than when passengers are moving in the car and at the moment when a passenger arrives or leaves from the car. In other words $$\hat{v}(t) = (\tau(k, a(t)) \geq \xi) \int_{T_0}^{T} a(t)\,dt \approx (\tau(k, a(k)) \geq \xi) \sum_{k=1}^{N} a(k)\Delta t \tag{3}$$

$$x(t) = \int_{T_0}^{T} \hat{v}(t)\,dt \approx \sum_{k=1}^{N} v(k)\Delta t$$

The test function $\tau(\bullet)$ occurring in the formula above (the so-called movement indicator), the purpose of which is to examine movement of the car, can be implemented e.g. with a sliding variance and with a time window $w_t$ of a suitable length.

$$W = \text{round}\left(\frac{w_t}{2\Delta t}\right) \tag{4}$$

$$\bar{a} = \frac{1}{2W} \sum_{i=k-W}^{k+W-1} a_i$$

$$\tau(k, a(k)) = \frac{1}{2W} \sum_{i=k-W}^{k+W-1} (a_i - \bar{a})^2$$

The threshold value $\xi$ can be set automatically based on the data material measured during the inspection period by arranging the values of the test function $\tau(k,a(k))$ into their order of magnitude and by selecting e.g. a sample $$\xi = \tau\left(\frac{2}{3}N, a(k)\right)$$

as a threshold value. In this way the selection of the threshold value is made immune to a fluctuation in individual values.

FIG. 2*a* presents the values of a test function calculated from acceleration with the formula (4) when the time window $w_t$ is 0.5 s. The arrows with the reference 100 describe the events of the acceleration curve, in which the test function detects movement in the car. The dashed line in the lower part of FIG. 2*a* presents the threshold value $\xi$ of the test function. In the other areas the speed is rendered to zero according to the formula (3). By comparing FIGS. 1, 2*a* and 2*b* it is observed that the speed already remains under better control, but the cumulative deviation is still troublesome. For example at the moment 133.8 seconds (arrow 102 in FIG. 2*b*) the car has the calculated speed −0.003 m/s, although the movement indicator also says the car is stationary in the next moment.

The application of formula (2) can be extended to apply to each area presented in FIG. 2*a* with the arrow 100. In other words, since the movement indicator $\tau(\bullet)$ says when movement of the car starts and ends, the formula (2) can be applied in segments to each such area separately. Although the car also inclines to different sides during loading and unloading, the bias terms caused by the inclination can be compensated out in segments by means of the formula (2) such that $T_0$ is the moment when the movement indicator $\tau(\bullet)$ reports that the movement has started and T is the moment when correspondingly the movement of the car has ceased.

FIG. 3 presents with this "segmented bias compensation" principle the calculated speed and position of the car during a loading situation. Now the bias errors (deviations) are under control and the step-like deviations caused by passengers is clearly seen in the position of the car. The car has moved less than 1 mm upwards and downwards from the position of the starting situation; approx. 900 μm upwards when a passenger exits and approx. 700 μm downwards when a passenger steps into the car. An ordinary MEMS (Micro-Electro-Mechanical Systems) acceleration sensor, or any other sensor whatsoever with which acceleration can be measured, can be used as an acceleration sensor.

From the standpoint of detecting passengers the speed of the car is better as a signal than the measured acceleration. Likewise the position of the car is better as a signal than the speed. The reason for this is that speed is a magnitude integrated once from acceleration and position is a magnitude integrated twice from acceleration. In terms of filter technology the position integrated from the acceleration corresponds to a second-order low pass filter. The vibrations and noise appearing in the original acceleration signal smooth out effectively and the actual transition produced by the excitation "collects" first in the speed and then in the position. The effect of integration is clearly seen when the top curve (acceleration) of FIG. 2*a* and the speed and position of FIG. 3 are compared. When the bias errors (deviations) are first compensated from the position of the car, the exits and arrivals of passengers can easily be seen. Thus the detection of passengers is preferably based on the signal describing the position of the car.

FIGS. 4, 5*a*, 5*b* and 6 present a method according to the present invention for detecting passengers. Passengers are detected with the correlation method.

In the first phase step-like changes in the position of the elevator car are sought. This is done e.g. with a sliding variance according to formula (2), in which case $$W = \text{round}\left(\frac{w_t}{2\Delta t}\right) \tag{5}$$

$$\bar{x} = \frac{1}{2W}\sum_{i=k-W}^{k+W-1} x_i$$

$$\tau_x(k, x(k)) = \frac{1}{2W}\sum_{i=k-W}^{k+W-1} (x_i - \bar{x})^2$$

where x(k) is the position of the car at the sampling moment k. The 0.5 s time window presented earlier can be used as the width of the window here also. The sliding variance forms a rounded peak at the point of the step-like changes of the car according to FIG. 4.

It is possible to endeavor to detect the peaks from their amplitude. A more reliable result is achieved however when the detection is performed e.g. by means of correlation. In this example the peak-shaped function is taken as the test function and it is slid from point to along the curve $\tau_x(k)$ (sliding correlation), in which case a new curve is obtained to describe the correlation of the test function to the tested curve in the environment of each point.

$$R(k) = \begin{cases} \dfrac{cvar(TF, X)}{stdev(TF)\cdot stdev(X)}, \\ 0, \text{ when } R(k) < 0 \vee stdev(X) < 0.1 \end{cases} \tag{6}$$

where TF is a vector of length m (m odd) containing samples from the test function, X is a sub-vector taken from the vector x such that the sample x(k) is the middlemost in the sub-vector X of length m.

FIGS. 5*a* and 5*b* present the sliding correlation R(k) between the test function TF and the sliding variance $\tau_x$ of the position of the car calculated with the formula 5. The test function TF at the time 129.5 s is also drawn in FIG. 5*a* and the correlation value 0 corresponding to this. The test function TF at the time 130.45 s is drawn in FIG. 5*b* and the correlation value 1 corresponding to this.

Since correlation examines the correspondence of two different functions and does not affect the magnitude between the functions in it, an arriving and an exiting passenger can be reliably detected with the correlation function R(k). The peaks of the function R(k) represent the time of the events. The nature of the event can be ascertained reliably by examining from the position of the car in which direction the car has moved in the environment of the detected peak. If the car has risen upwards, a passenger has exited the car. Likewise, if the car has settled downwards, a passenger has arrived in the car. In FIG. 6 the final results obtained when a passenger exits from and steps into the car two different times during the same stop are collated; at the moment 125.3 s (out), 127.6 s (in), 130.5 s (out) and 132.9 s (in). The event subsequent to the time 132.9 s (in other words, settling of the car downwards) is caused by walking inside the car, which "shakes" the car downwards.

All in all, the detection of passengers can be performed in many different ways. For example, U.S. Pat. No. 5,518,086 (Tyni) describes a method that uses neural networks for detecting passengers from the car load weighing signal. The load weighing signal, either a floor load weighing device or an upper beam load-weighing device, corresponds in its nature to the position signal of the car presented here. This being the case, the method disclosed in the aforementioned patent can be used directly in the position information of the car now presented.

The information about passengers obtained can be used together with other data of the condition monitoring system and to form floor-specific traffic statistics for the relevant elevator. By transferring elevator-specific statistics to a servicing center, it is possible to combine information about elevators serving in the same group and to from the traffic statistics of the group. The information can also be conveyed to the control system of the elevator group, in which case the control system of the elevator group can be adapted to the prevailing and/or to the forecast traffic situation in order to enhance the efficiency of service of the elevator group.

The solution disclosed in the present invention can be used in new as well as in existing elevators and also in elevators manufactured by any manufacturer whatsoever. Traffic information at different floors and traffic charts can be offered e.g. as an added-value service to important customers. Monitoring and guiding the passenger flows of buildings e.g. in shopping centers obtains useful information about passenger numbers.

The solution disclosed in the present invention is used in one embodiment in condition monitoring, namely in measuring the photoelectric cell delay. Numerous intervals that belong to the operating cycle of an elevator are measured and monitored in an elevator system, e.g. run time, starting delay, run cycle time, door-open time, door-closed time, etc. The photoelectric cell delay is defined as the time from the moment after the last passenger detected with the door photoelectric cell to the moment when the doors of the elevator start to close. Based on the solution according to the invention for detecting passengers, the condition monitoring system can now monitor and supervise the behavior of the photoelectric cell delay (information about the opening/closing of the door is obtained e.g. from the condition monitoring system or directly from the door operator of the elevator car). The photoelectric cell delay is one of the aspects affecting the safety of passengers, ride comfort and the performance capability of the elevator. The inoperability of the photoelectric cell can be detected quickly and reliably e.g. as follows: if the door does not re-open although the passenger detected with the acceleration sensor has walked between the closing door, it can be interpreted as a possible defect in the photoelectric cell. In addition the operation of the control of the elevator can be monitored, in other words whether the control changes the photoelectric cell delay e.g. in peak-traffic situations and on entry floors. Generally the solution according to the invention can be used in connection with condition monitoring systems for measuring numerous indicative parameters of the operation and the utilization rate of the elevator e.g. in assessing the modernization need of an elevator already in use.

Furthermore, in one embodiment of the invention an automatic emergency phone call to the service center is made if the elevator stops between floors and there is a passenger or passengers in the elevator car. The condition monitoring system of the elevator knows the position in meters of the elevator car in the shaft, and likewise it knows the door zones and when a stop is made between door zones (=floors). In addition the condition monitoring system is able to detect, based on the acceleration signal of the car, the nature of the stop; it is able to distinguish an emergency stop from a normal stop. In this embodiment the condition monitoring system can if necessary activate an emergency phone call to the service center if it appears that the elevator is not able to start moving by its own efforts. At the same time the system can supply technical data about the event, such as the estimated number of passengers in the car, between which floors the elevator is, the stopping method (emergency/normal), etc.

FIG. 7*a* presents one preferred embodiment of the system according to the invention. The system of FIG. 7*a* comprises an elevator car 708, which has stopped at a floor 704. There are two passengers in the elevator car from before. A third passenger 710 is stepping into the elevator car 708 from the floor 704. When the passenger 710 steps into the elevator car 708, the acceleration sensor 700 fixed to the elevator car 708 registers the vertical movement of the elevator car 708. The measurements of the acceleration sensor 700 are conveyed to the processing unit 702 along the connection 706. The connection 706 can be a wireless or a wired connection. It is also obvious (as an exception to FIG. 7*a*) that in connection with the elevator car 708 can be a device that collects the measurement results gathered by the acceleration sensor 700, and the device sends the results to the processing unit 702. The operation of the processing unit 702 is described in more detail in conjunction with FIGS. 2-6.

In one embodiment of FIG. 7*a* the processing unit 702 presents a part of a more extensive monitoring system and/or condition monitoring system, which is implemented in the elevator system already in its construction stage. FIG. 7*b* presents a second solution according to the invention to implement the monitoring of passengers. In the embodiment presented in FIG. 7*b* the monitoring is implemented as a separate solution e.g. only after the construction stage. In this case one or more interfaces 714 can be arranged to the processing unit 702, via which information can be obtained from the processing unit 702 e.g. for a monitoring system 712, for a remote system of the servicing center/service center, for the control system of an elevator and/or an elevator group or any other similar separate system whatsoever. Information, such as e.g. information about the opening/closing of the doors, can also be conveyed to the processing unit 702 via the interface. The actual analysis of results obtained from the acceleration sensor can be performed with a computer program saved in a suitable memory, which is arranged when run on a data processing appliance to perform the analysis phases presented in the invention.

The invention is not limited solely to the embodiments described above, but instead many variations are possible within the scope of the inventive concept defined by the claims below.

The invention claimed is:

1. A method for detecting the arrival in the elevator car and/or departure from the elevator car of elevator passengers, the method comprises the steps of:

receiving vertical acceleration values of the elevator car from an acceleration sensor; and detecting the arrival in the elevator car and/or departure from the elevator car of an elevator passenger on the basis of the vertical acceleration values of the acceleration sensor.

2. The method according to claim 1, wherein the detection phase further comprises the steps of:

calculating a calculated speed of the elevator car from the vertical acceleration values of the acceleration sensor;

preprocessing the calculated speed by rendering the speed of the elevator ear as zero elsewhere except in a passenger loading situation or a passenger unloading situation; and detecting the arrival in the elevator car and/or departure from the elevator car of an elevator passenger from the preprocessed speed on the basis of position of the elevator ear.

3. The method according to claim 2, wherein the step of preprocessing further comprises using a movement indicator in the preprocessing, which detects a passenger loading situation or a passenger unloading situation from the fluctuation of movement of the car.

4. The method according to claim 1, wherein the step of detecting further comprises detecting the arrival in the elevator car and/or departure from the elevator car of an elevator passenger from the preprocessed speed on the basis of the calculated position of the elevator car with a correlation method.

5. The method according to claim 1, further comprising the steps of:

detecting the arrival of the passenger last arriving in the elevator car or the departure of the passenger last leaving the elevator car; and measuring the photoelectric cell delay of the elevator on the basis of the detection.

6. A computer program embodied on a computer readable medium and configured to perform the method according to claim 1.

7. The computer program according to claim 6, wherein the computer program is stored on a data processing appliance on a readable storage medium.

8. A device for detecting the arrival in the elevator car and/or departure from the elevator car of elevator passengers, wherein the device is arranged to receive vertical acceleration values of the elevator car from an acceleration sensor and to detect the arrival in the elevator car and/or departure from the elevator car of an elevator passenger on the basis of the vertical acceleration values of the acceleration sensor.

9. The device according to claim 8, wherein the device is arranged:

to calculate a calculated speed of the elevator car from the vertical acceleration values of the acceleration sensor;

to preprocess the calculated speed by rendering the speed of the elevator car as zero elsewhere except in a passenger loading situation or a passenger unloading situation; and to detect the arrival in the elevator car and/or the departure from the elevator car of an elevator passenger from the preprocessed speed on the basis of the calculated position of the elevator car.

10. The device according to claim 9, wherein the device is arranged to use a movement indicator in the preprocessing, which detects a passenger loading situation or a passenger unloading situation on the basis of the movement of the elevator car.

11. The device according to claim 8, wherein the device is arranged to detect the arrival in the elevator car and/or the departure from the elevator car of an elevator passenger from the preprocessed speed on the basis of the calculated position of the elevator car with a correlation method.

12. The device according to claim 8, wherein the device is arranged to detect the last passenger arriving in the elevator car or the last passenger leaving the elevator car and to measure a photoelectric cell delay on the basis of the detection.

13. The device according to claim 8, wherein the device comprises at least one interface for connecting the device to one or more separate systems; and the device is arranged to convey information about the passengers to at least one aforementioned separate system.

14. A system for detecting the arrival in the elevator car and/or departure from the elevator car of elevator passengers, which system comprises:

an elevator car; and an acceleration sensor that measures the acceleration of the elevator car;

wherein the system comprises an analyzer that receives vertical acceleration values of the elevator car from the acceleration sensor and detects the arrival in the elevator car and/or the departure from the elevator car of an elevator passenger on the basis of the vertical acceleration values of the acceleration sensor.

15. The system according to claim 14, wherein the analyzer is further arranged:

to calculate a calculated speed of the elevator car from the vertical acceleration values of the acceleration sensor;

to preprocess the calculated speed by rendering the speed of the elevator car as zero elsewhere except in a passenger loading situation or a passenger unloading situation; and to detect the arrival in the elevator car and/or departure from the elevator ear of an elevator passenger from the preprocessed speed on the basis of the calculated position of the elevator car.

16. The system according to claim 15, wherein the analyzer is further arranged to use in the preprocessing a movement indicator, which detects a passenger loading situation or a passenger unloading situation from the fluctuation of movement of the ear.

17. The system according to claim 14, wherein the analyzer is arranged to detect the arrival in the elevator car and/or the departure from the elevator car of an elevator passenger from the preprocessed speed on the basis of the calculated position of the elevator car with a correlation method.

18. The system according to claim 14, wherein the analyzer is arranged to detect the arrival of the last passenger arriving in the elevator ear or the departure of the last passenger leaving the elevator car, and the system further comprises a determination device that measures the photoelectric cell delay of the doors of the elevator on the basis of the arrival or the departure of the detected last passenger.

19. The method according to claim 2, wherein the step of detecting further comprises detecting the arrival in the elevator ear and/or departure from the elevator ear of an elevator passenger from the preprocessed speed on the basis of the calculated position of the elevator car with a correlation method.

20. The method according to claim 3, wherein the step of detecting further comprises detecting the arrival in the elevator car and/or departure from the elevator car of an elevator passenger from the preprocessed speed on the basis of the calculated position of the elevator car with a correlation method.

* * * * *